United States Patent [19]

Henriques

[11] 4,230,092

[45] Oct. 28, 1980

[54] METHOD AND APPARATUS FOR IMPROVEMENTS IN CONVECTIVE HEATING

[76] Inventor: Joseph Henriques, 24 Hidden Brook Dr., Brookfield, Conn. 06804

[21] Appl. No.: 897,009

[22] Filed: Apr. 17, 1978

[51] Int. Cl.[3] ..... F24C 15/30

[52] U.S. Cl. ..... 126/126; 126/120

[58] Field of Search ..... 126/126, 110, 120, 83

[56] References Cited

U.S. PATENT DOCUMENTS

| | | | |
|---|---|---|---|
| 1,029,151 | 6/1912 | Taylor | 126/120 |
| 2,733,705 | 2/1956 | Goulding, Sr. | 126/127 |
| 3,952,721 | 4/1976 | Patterson | 126/126 |
| 4,026,264 | 5/1977 | Henriques | 126/126 |
| 4,060,068 | 11/1977 | Lever et al. | 126/120 |
| 4,062,344 | 12/1977 | Mayes | 126/120 |

*Primary Examiner*—Samuel Scott
*Assistant Examiner*—Wesley S. Ratliff, Jr.
*Attorney, Agent, or Firm*—Mattern, Ware, Davis & Stoltz

[57] ABSTRACT

The efficiency of a convective heating system employing an elongate firebox is dramatically increased by, inter alia, increasing combustion zone volume to approach that of the firebox and increasing residence time of rising combustibles at ignition temperatures.

29 Claims, 9 Drawing Figures

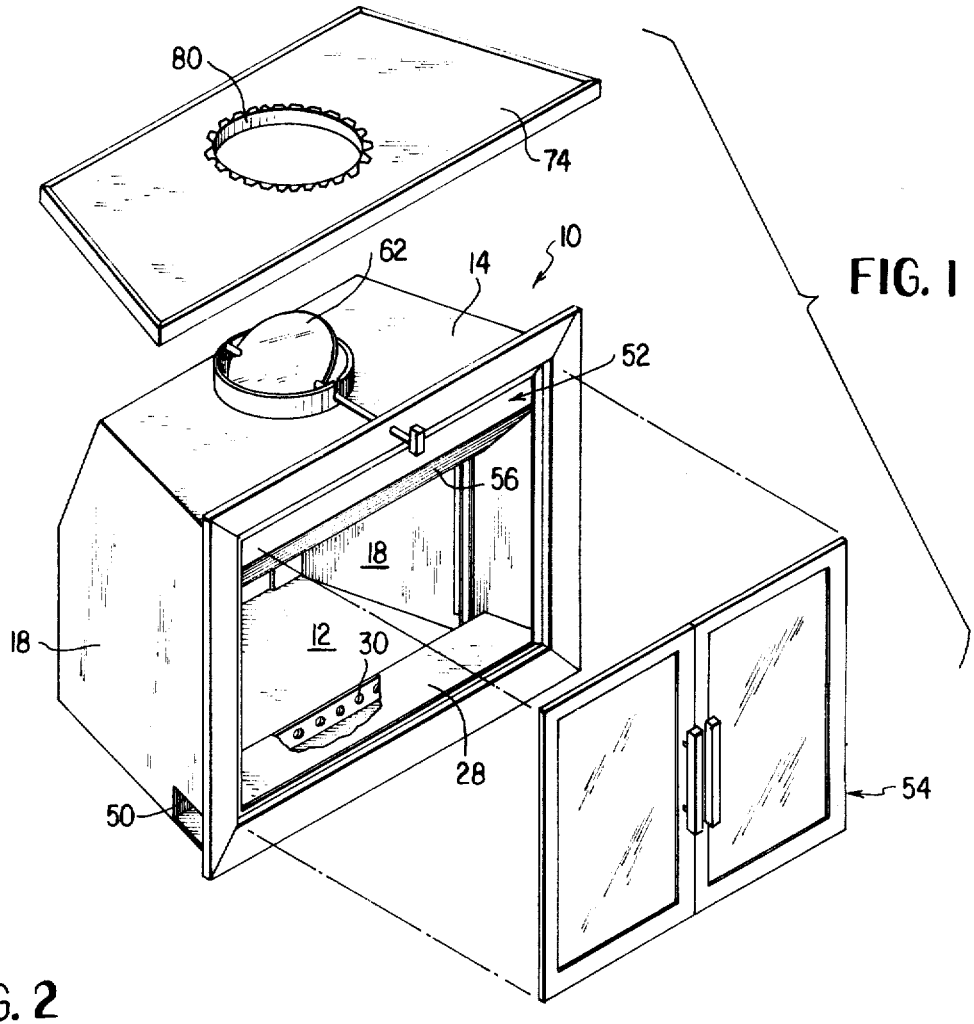
FIG. 1
FIG. 2
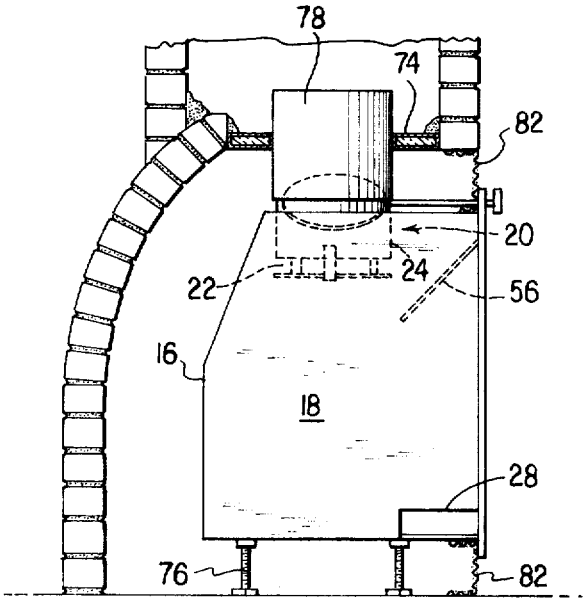
FIG. 3
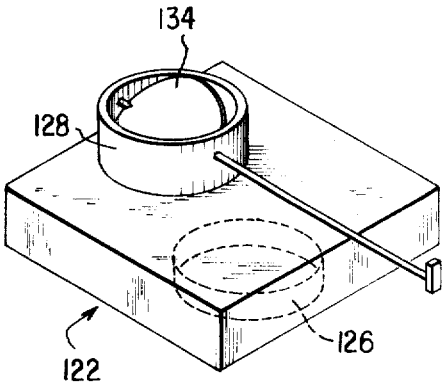

METHOD AND APPARATUS FOR IMPROVEMENTS IN CONVECTIVE HEATING

BACKGROUND OF THE INVENTION

The aesthetic value of open fireplaces is such that their inefficient heating abilities are endured even to the point of reducing overall fuel efficiency for the buildings in which they are employed. The reasons for the latter are well known. The fireplace, itself, is an inefficient heat source because most of the heat of combustion escapes up the chimney and the strong draft thereby created exhausts warm air from the building thus lowering overall building temperature outside the immediate fireplace area. This, in turn, calls upon the central heating system to stabilize the heat loss.

Convective heating systems have long been employed in conjunction with conventional fireplace structures as a means of recovering a portion of that heat normally lost to chimney draft and replacing, with recuperatively heated air, at least a portion of the withdrawn room air. Convective heating systems conventionally employ a fuel burning stove or firebox positioned within a fireplace enclosure in spaced relation to the back, sides, and/or bottom walls of the enclosure. The firebox is vented to a chimney or stack and sealed with respect to the space between the firebox and fireplace enclosure. As fuel is burned in the firebox limited room air is withdrawn, to support combustion, through a firebox inlet grate and the products of combustion are exhausted to the chimney or stack. When the firebox walls become heated a convective air flow is established in the space between the firebox and fireplace enclosure withdrawing relatively cool room air from adjacent the floor which is heated as it passes inwardly and upwardly within the fireplace enclosure prior to its reintroduction into the room from the upper portion of the enclosure. In addition to providing room heat by radiation, the firebox is the heat source to establish and heat a convective flow of room air. Firebox improvements since the early "Latrobe" system (U.S. Pat. No. 4,744) have included an elongate, glass fronted construction whose generally trapezoidal shape in horizontal section approximates that of a fireplace enclosure for purposes of improving convective flow and retaining the aesthetic appearance of a conventional fireplace; improved combustion air controls; and specially configured outer wall constructions for improved heat exchange with the convective flow path as exemplified by U.S. Pat. Nos. 4,026,264; 4,026,263 and 4,015,581, respectively. The use of glass doors on the front wall of the firebox constituted a major design improvement which is now the accepted mode of construction in that such doors ameliorate draft induction of room air while retaining the aesthetic value of an "open fire".

Aside from such basic firebox improvements the general trend in convective heating systems has been in the direction of improving recuperative efficiency with respect to a given heat source. Exemplary are improved heat exchange techniques in the form of fins and/or flow path directors and methods for increasing convective mass flow such as by the use of blowers and the like.

The problem has been attacked from the wrong end. The limitations inherent in the heat source have been accepted as more or less given parameters to be tolerated or ignored. Stated differently, for a given quantity of the same fuel and external factors being equal, the available BTU's for convective heat exchange does not vary significantly among the various systems that have been in use for years. The key to dramatic increases in overall unit efficiency lies with the heat source (firebox) itself which, historically, has been one of the most inefficient heating units ever designed.

In the ensuing discussion explanatory of the foregoing it must be borne in mind that the concern herein is for elongate fireboxes retaining the visual aesthetics of an open fireplace since many of their inherent limitations derive from this general configuration.

In considering, for purposes of discussion, a conventional elongate wood burning firebox having a generally centralized flue and supplied by drafted combustion air below a glass fronted wall; the hottest portion of the fire is centrally of the firebox. Indeed, in many instances the outer ends of the fuel logs either do not burn at all and must later be stoked to the center or only become consumed after a substantial bed of glowing embers is established. In such conventional firebox there is a central zone which maintains ignition temperatures while areas transverse of the central zone remain below ignition temperature. The reasons are twofold. The net mass flow of combustion products is upward to a central flue creating a centrally flowing draft (i.e. away from the outer ends of the fuel logs) which, in turn, creates a centrally directed flow of incoming combustion air to the center of the firebox even though combustion air inlets may extend completely across the front of a closed firebox. Once the overall central flow of combustion products and incoming combustion air is visualized then the inherent creation of a central ignition zone is readily understandable on the basis of general thermal theory that upon attainment of flame supported ignition temperature (i.e. that temperature at which the local rate of heat generation is sufficient to propogate the flame throughout the combustible) the same will maintain until fuel exhaustion or quenching occurs. Since quenching, or localized quenching as applied to the present discussion, occurs because of:

(1) a rate of heat loss such as to cause local chilling below ignition temperature; or (2) insufficient oxygen to support combustion, it will be seen how the central flow of combustion products and incoming combustion air contribute individually, and collectively, to localized chilling and decreased oxygen partial pressures transversely of the central flow zone which quenching effect increases directly as a function of net mass flow velocity. The result, following initial ignition by highly combustible materials, is transverse quenching dilimiting the central ignition zone. If, as is the usual case, initial ignition is effected centrally of the firebox, the remote ends of the box tend to remain well below ignition temperature.

Expressed differently, a conventional firebox whose central ignition zone is bounded on either side by sub-ignition temperature zones exhibits large temperature gradients transversely of the firebox which peak centrally and drop off rapidly, below ignition temperature, toward both ends of the firebox. The effect is readily visible from the greater amount of smoke emanating from the ends of the logs and the greater soot and resin depositions adjacent the ends of the firebox.

The value of vertical temperature gradients vary greatly depending upon their position within the firebox as would be expected from the above discussion of central draft to flue. Considering a central portion of the firebox, the temperature drops somewhat from the point where oxidation of the combustible gases take place to the flue entrance but this central, vertical gradient becomes quite small (lying wholly within the ignition temperature range) as the firebox interior is further heated by radiation. Similarly, vertical gradients adjacent remote ends of the firebox are quite small (lying within the sub-ignition temperature range). Looking, however, to those diagonal temperature gradients extending from outside the central area of the firebox, upwardly toward the flue entrance (the direction of induced draft); the value of such diagonal gradients are quite large (extending from sub-ignition to ignition temperature ranges). Similarly, those vertical temperature gradients intermediate the central and remote portions of the firebox, i.e. lying just outside the axis of flue exhaust, exhibit a large value as they extend vertically from an ignition temperature range adjacent the burning fuel source upwardly to a sub-ignition temperature range transverse of central flue exhaust. The minimal value of the central vertical gradient as contrasted with the larger vertical gradient transversely thereof is, of course, an indication of the large amount of heat being lost up the flue.

Since the fuel source is positioned rearwardly of the firebox to avoid overheating the glass front it will be seen that the aforedescribed temperature gradients define a generally frustoconically shaped combustion zone of relatively high (ignition) temperature as contrasted with the lower temperature zones bounding either side and the front thereof. Accordingly it is the central portions of the top and backwalls of the firebox which provide the most effective heat exchange for the convective flow path with the remainder of the firebox walls available for heat exchange being at a substantially lesser temperature.

Although the aforedescribed central drafting effect of a central flue can be somewhat ameliorated and the generally conical combustion zone somewhat elongated at the truncated end thereof by the use of an elongated flue of the type shown in U.S. Pat. No. 4,026,264; the small advantage is more than offset by the fact that down drafts from such a flue whirl the flames transversely and forwardly overheating and sooting the doors. Additionally, thermal expansion and contraction of such an elongated flue inevitably breaks its seal to the connected flue or chimney, thus allowing loss of convected room air up the chimney.

The primary purpose of the invention is to substantially reduce both the horizontal and vertical temperature gradients within the firebox to the extent that the aforedescribed combustion zone, fueled with a like charge, is expanded to encompass a generally rectangular volume approximating that of the firebox. This is effected by precluding the direct escape of hot rising flue gases and momentarily trapping the same to lie, in effect, as a hot air blanket in heat exchange relation over the entire lower surface of the upper firebox wall prior to continuing displacement of the same to flue by subsequently rising, hotter flue gases. The substantial elimination of direct flue escape produces a concomitant decrease in the centralizing components of the combustion air draft permitting combustion air to be introduced equally to the fuel across the length of the firebox. The latter, taken with that radiant heat downwardly directed from the overlying hot air blanket, maintains ignition temperatures at extreme ends of the firebox the rising flue gases from which join and supplement the hot air blanket. The result is a generally rectangular combustion zone maintained at ignition temperatures throughout substantially the entire firebox except immediately adjacent the glass doors. The effect is augmented and efficiency is further increased by preheating the combustion air prior to its entry into the firebox via a preheat manifold construction which not only provides a measure of air shielding for the glass doors but limits the forwardmost extent of fuel placement to prevent overheating of the glass.

The increase in both radiant and convective heating efficiency is dramatic. The most obvious advantage is that substantially the entire surface area of each of the back, top, bottom and side walls is now maintained at a much higher temperature than was previously possible thereby greatly increasing convective heat exchange efficiency without the expense of heat exchange assistants such as fins, convoluted flow paths and the like. An ancillary advantage supplementing the foregoing and desirous in and of itself is the virtually complete combustion effected within the firebox as a consequence of the greatly increased path length along which the combustion products must traverse the combustion zone prior to exiting the flue. This is evidenced by the virtual elimination of both soot within the firebox and resinous buildup in the chimney. Immediate visual recognition, during burning, is had by virture of the fact that fire logs burn evenly from end to end in a virtually smoke free environment immediately following full ignition.

Although, as previously indicated, the use of glass doors on units of the type herein proposed has become fairly standard in the industry the problem of glass breakage due to uneven heating is still prevalent. Major contributing factors are continuing localized cooling adjacent the lower edge of the glass by incoming combustion air and momentary, intense localized heating due to flash fires. An additional advantage in preheating the combustion air prior to firebox entry is that it reduces localized glass cooling. A combination of air shielding and baffles alleviate flash fire effects on the doors.

The firebox construction herein described is adapted for use with convective heating systems employing a free standing, or fabricated, fireplace unit as well as conventional firebrick enclosure. When used with a free standing unit over a combustible floor surface, the unusually intense heat radiated from the firebox necessitates special safety precautions exceeding those required for previous units and takes the form of air cooling to supplement the usual metal and insulative shielding.

Another purpose of the invention as applied to free standing units is to utilize convected room air to effect such cooling and then utilize the air thus heated for separate space heating or for reintroduction into the room heated by the conventionally convected air flow.

Secondary heat recovery is frequently effected by directing the convective flow in heat exchange relation with the flue pipe to extract further heat destined for loss to atmosphere. It is a further object of the invention to enhance the efficiency of this exchange by increasing both the sensible heat available for exchange and the surface area for effecting the same. This is accomplished by creating an upper heated air trap, within the flue, analogous to the aforedescribed entrapment of heated air within the firebox.

SUMMARY OF THE INVENTION

The overall heat available from a given firebox fuel source for the recuperative exchange with convected room air varies indirectly with net mass flow velocity to central draft and directly with heat exchange surface area temperature which, in turn, is a direct function of the volume ratio of combustion zone to firebox.

In the case of an elongate, centrally drafted firebox; a baffled, deep flue (i.e. a flue whose intake extends well below the upper firebox wall) is employed to divert the hot flow of nascent combustion products from direct escape to draft and entrap the same as a continually renewing hot air blanket underlying the upper firebox wall to a depth approximating the "reach" of the flue entrance into the firebox. With centralizing draft thus reduced, nascent combustion products from the ends of the firebox rise to supplement the overlying hot air blanket and maintain the same dynamically stable over the length of the firebox as the hotter rising gases continually effect displacement to the deep flue inlet. Once ignition along the length of the firebox is established, merger of the heated gases instantaneously trapped above the deep flue inlet and the rising nascent products of combustion produce a firebox interior which, with appropriate oxygen supply to avoid quenching, is maintained above ignition temperature throughout substantially the entire volume thereof. Consequently, substantially the entire surface areas of the bounding back, top, bottom and side walls comprising the heat exchange surface area are maintained at those maximum temperatures characteristic of immediate proximity to the combustion zone. This in contrast with the central areas of the back, top and bottom walls immediately adjacent a conventional, central combustion zone as described above.

In addition to providing a greater surface area of high temperature exposure for convective heat exchange an important factor in the case of a firebrick enclosure is the greater and more even buildup of residual heat in the relatively massive heat sink defined by the firebrick wall.

In order to avoid quenching at remote ends of the firebox either from oxygen starvation or localized cooling by incoming combustion air, the combustion air is preheated and introduced along the length of the firebox from a preheat manifold which is open at both ends. This open ended construction insures against reduced combustion air flow at remote ends of the box due to a pressure drop along the manifold.

While the foregoing describes a combustion zone whose volume approaches that of the firebox with the obviously increased heat transfer to convected air; less obvious are the advantages considered as a function of the combustion products flow paths thus established within the firebox. In a conventional, elongate firebox exhibiting a central combustion zone the mean average flow of combustibles is upwardly and centrally and the shortest possible flow path to flue for any discrete volume of the mean average flow is determined by the length of the hypotenuse of that right triangle whose altitude extends along the flue axis from fuel source to flue exit and whose base is determined by the horizontal distance from the flue axis to the point of emanation from the fuel source. By effectively blocking direct escape to flue and establishing a constantly renewing, entrapped volume of the hottest gases above the deep flue entrance, the mean average flow path for rising combustibles is greatly increased and may be visualized as an upward, transverse and reentrant movement respectively into, along and out of the entrapped volume to exit the deep flue. The result is to increase the shortest possible flow path to flue for any discrete volume of the mean average flow from a value approaching $\sqrt{a^2+b^2}$ to a value approaching a+b where a is that vertical distance, along the flue axis, from fuel source to flue exit and b is the horizontal distance from flue axis to the point of emanation from the fuel source. Since the volume of the combustion zone approaches that of the firebox, the result is greatly increased residence time of combustibles at ignition temperatures effecting the completeness of combustion referred to above as evidenced by decreased smoke, soot and resinous deposition.

An elongate baffle extending downwardly and inwardly from the upper front of the firebox to a depth exceeding that of the deep flue "reach" cooperates on the one hand with the deep flue construction to maintain the entrapped volume and, on the other, with the underlying preheat manifold to shield the doors from excessive temperatures.

The preheat manifold lies flush with the firebox floor and extends completely across the front thereof with opposed intakes opening through the firebox endwalls. This floor flush construction coupled with the provision of manifold exit openings positioned near the floor assure that any ashes entering the same during "clean out" or the like will be subsequently drafted back into the firebox maintaining a clean preheat manifold.

With the reduction of net mass flow velocity made possible by the present invention it is not only unnecessary, but is undesirable, to employ a separate combustion air inlet control such as a grate or the like since, where substantially complete combustion is taking place, control of flue exhaust as by a conventional damper inherently produces a stoichiometric oxygen admission if, and only if, the supply as by way of quantity is available in excess for any burn condition. Thus the choice of an open ended preheat manifold exhibiting a negligible pressure drop across the plurality of relatively large exit openings. In further explanation of the foregoing: In a conventional firebox exhibiting large subignition areas it is necessary to create a strong central draft to exhaust the smoke inherently emanating from such areas to preclude fire extinguishment and/or their entry into the room. The draft damper, then, must be further opened than would be necessary if the subignition temperature zones were of lesser extent producing less uncombusted products. This, in turn, in drafts more room air far in excess of a simple stoichiometric oxygen supply which further increases net mass flow to draft to thus maintain the large subignition temperature region as explained above. Where, on the other hand as in the present invention, the combustion zone volume approaches that of the firebox, smoke and other uncombusted products are practically non-existent eliminating the necessity for their draft removal for purposes of removal per se. Rather, draft may now be controlled as a function of desired burn rate thus eliminating the need for an inlet grate. As would be expected from the foregoing, the optimum flue damper opening is quite small as compared with conventional units.

The reduction of central draft and the particular placement of the preheat manifold serve a further function, in combination with the overlying baffle previously described, of allowing more of the incoming combustion air to rise just rearwardly of the door. This in combination with the inherent leakage of room air over the tops of the glass doors and the inward and downward component imparted to the constantly renewing air blanket by the upper baffle acts to shield the door.

In addition to the nascent combustion products diversion function already described, the deep flue baffle serves the usual function of a smoke shelf. In the case of a round flue as herein contemplated it is important that the flue entry area between the flue entrance and baffle be completely open. For this reason the baffle is suspended from the flue by small hanger assemblies which provide for vertical adjustment, during installation, of the clearance between baffle and flue entrance to take into account the usual differences in chimney draft. With a strong drafting chimney the baffle will be placed closer to the flue entry while a greater clearance is desired for weaker drafting chimneys. Typically, the baffle plate will be positioned from 1½–3 inches below a deep flue having a 3" "reach".

All of the foregoing advantages are retained in the case of free standing units as herein disclosed except for the increased efficiency made possible by the greater heat storage in the firebrick heat sink. In the case of free standing units, a secondary recovery is effected and insulation of adjacent combustible surfaces improved by a secondary convective flow, exterior of the primary convective flow across the firebox walls, which may be introduced into the same or a different room than that heated by the primary flow.

DESCRIPTION OF THE DRAWINGS

FIG. 1 is a perspective view of a firebox constructed in accordance with the present invention and an associated fireplace pan for installation of the same;

FIG. 2 is an end elevation of the firebox installed in a firebrick enclosure, with the enclosure shown in section;

FIG. 3 is a perspective view of a flue trap structure;

Figure 4:
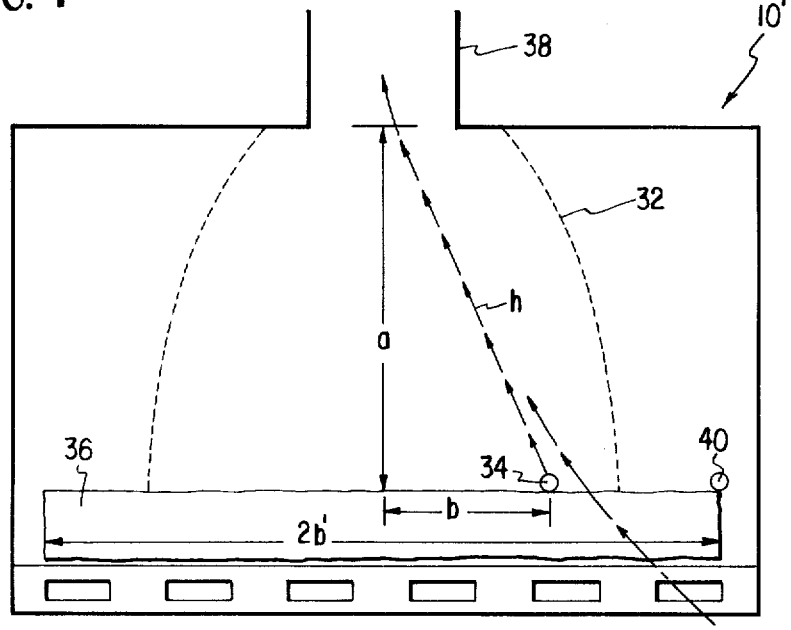
FIGS. 4 and 5 are respective schematic representations of exemplary mean average flow paths in a conventional firebox and the firebox of FIG. 1.

Part dimensions, except for wall thickness illustrations to permit hatching, are drawn to scale of 2":1'.

DESCRIPTION OF THE PREFERRED EMBODIMENTS

A glass fronted, elongate firebox 10 having bottom, top, back and side walls 12, 14, 16, 18 adapted for positionment in spaced relation to corresponding fireplace enclosure walls for defining therewith a convective flow path is shown in FIGS. 1, 2, and 7–9.

Firebox 10 includes a baffled deep flue assembly 20 which diverts nascent combustion products from direct escape to flue and entraps the same as a continually renewing hot air blanket lying above the level of annular flue entry 22 which is open throughout substantially 360° between the lower end of downward flue extension 24 and underlying baffle 26. The effect of the deep flue assembly 20, following full fuel ignition fed by preheated combustion air introduced across the full length of the firebox via open ended preheat manifold 28 and combustion air inlets 30, is to establish a combustion zone whose volume approaches that of the firebox. The FIG. 5 schematic is illustrative.

The concept will best be understood by initial consideration of the centralized combustion zone typical of a conventional, elongate firebox 10' depicted in FIG. 4; it being understood that the concern herein is only for elongate, centrally drafted fireboxes of the type employed with a convective heating system to retain the aesthetics of a conventional open fireplace. Following full ignition in a conventional firebox 10', the unrestricted flow of nascent combustion products directly to central flue produces a strong centralizing draft within the firebox so that the combustion zone tends to stabilize centrally as exemplified by the phantom line 32 of FIG. 4. Subignition temperature zones stabilize at remote ends of firebox 10' either because combustion was initiated centrally and ignition temperatures were never attained or due to localized quenching as previously explained. In either event, as net mass flow to central draft increases by reason of increased burn rate, fuel supply or combustion air inlet area, localized quenching at remote ends of the firebox is maintained even though the centralized combustion zone might be somewhat expanded.

With reference to FIG. 4 and considering any finite volume of nascent combustion products arising from a given area 34 adjacent fuel source 36 at a distance b from the axis of flue 38; it will be seen that the shortest possible flow path h to flue approaches $\sqrt{a^2+b^2}$ were a is the height of the firebox above the fuel source emanation area 34. Even when this flow path h is completely within the central combustion zone as illustrated in FIG. 4, combustion of the products is usually incomplete prior to exiting the firebox due to the relatively short residence time at ignition temperature. The problem of incomplete combustion with concomitant smoke production is, of course, more pronounced in the case of those products arising from subignition temperature areas adjacent remote ends of the fuel source, such as at 40 for example. Increased smoke production, in turn, requires that draft velocity be maintained to avoid smoke escape into the room thereby maintaining localized quench conditions at remote ends of firebox 10'. The obvious result is maximal heat loss to flue and a concentration of that heat available for recuperative exchange at the central portions of the top and back walls of the firebox.

Figure 5:
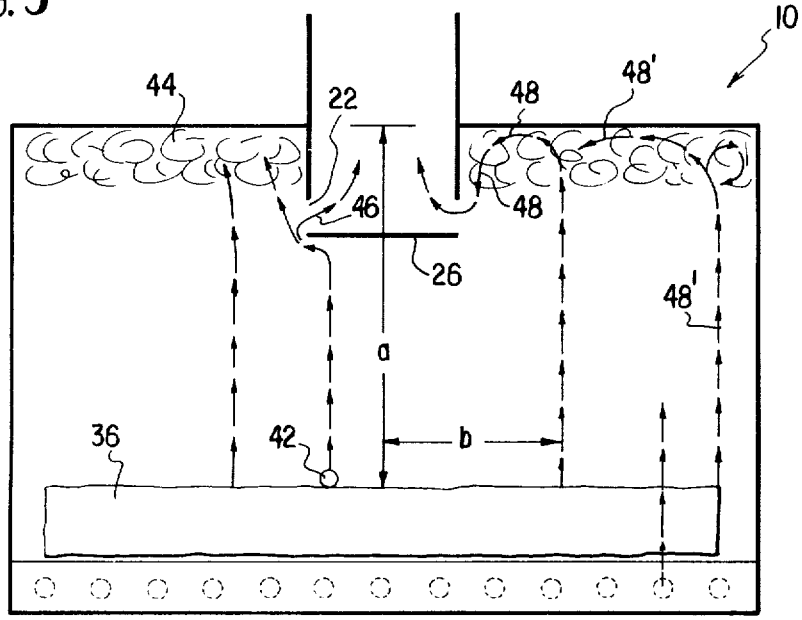
Figure 6:
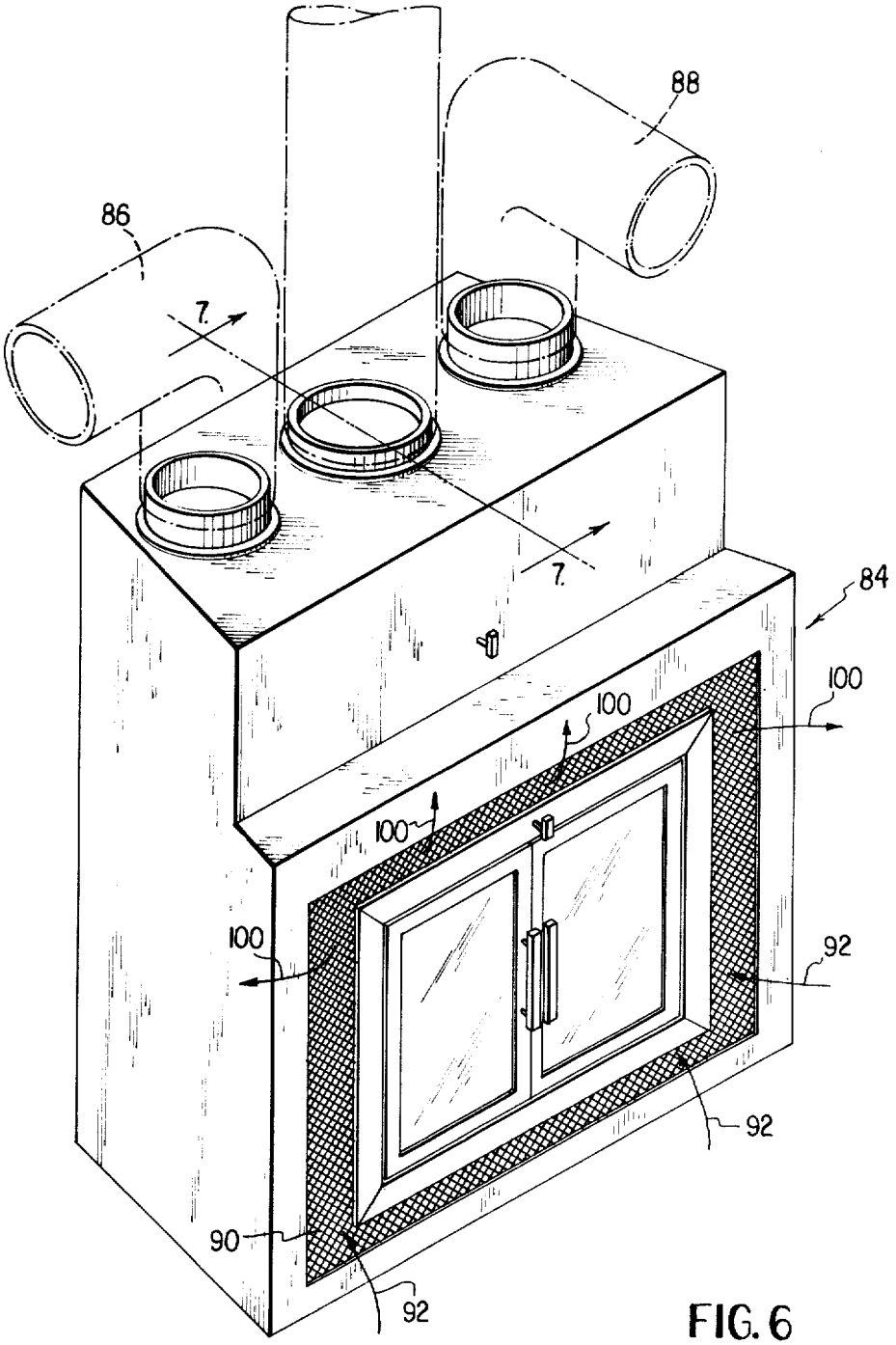
FIG. 6 is a perspective view of a free standing fireplace enclosure adapted to contain the firebox of FIG. 1.

The firebox 10 of the present invention retains much of that heat conventionally lost to flue and makes the same available for recuperative exchange over a significantly greater surface area in a manner which will be obvious from an inspection of FIG. 5 wherein most of those products of combustion arising from a generally centralized area 42 are diverted by baffle 26 from direct flue entry to supplement and displace a portion of that volume of combustion products previously entrapped more or less as a hot air blanket overlying flue entry 22. With central drafting effect thus reduced, nascent combustion products arising laterally of the flue exit have a significantly lesser centralizing flow component and rise to join, supplement and maintain the dynamic integrity of hot air blanket 44 as continuing displacement to flue takes place. The result is that more heat is retained within firebox 10 and ignition temperatures are maintained substantially throughout the entire firebox just rearward of the doors. There are two distinct effects. First, substantially the entire cumulative areas of the bounding firebox walls are proximate to ignition temperatures thus greatly increasing convective exchange efficiency and, secondly, the residence time of combustion products within the firebox and exposed to ignition temperature is increased as a function of their increased flow path length from a minimal value approaching $\sqrt{a^2+b^2}$ to one approaching $a+b$. While a miniscule proportion of the rising combustion products are entrained directly to flue as at 46, the average net mass flow is upwardly into the overlying hot air blanket, centrally toward flue and then downwardly to flue entry 22 as schematically indicated by flow path 48 in FIG. 5. It will be seen that the initial rising portion of flow path 48 approaches the height a of the firebox above the fuel source and that the centrally and downwardly directed portions of the path length to reach flue entry 22 approaches length b. With the idealized schematic flow path 48 as illustrated the flow path length would appear to be very nearly equal to a+b but actually this path length approaches a+b from the maximal side due to the random motion deviants from a straight line undergone by the combustion products in their traversal through the hot air blanket. It will be seen, however, that the shortest possible flow path to flue in the firebox 10 approaches a+b when considering the integral of all flow paths across the firebox and those minor inducted flows, as at 46, which approach the value a+b from the minimal side. The longer average flow path translates to increased residence times and more complete combustion which, of course, increases overall temperature available for exchange from a given fuel source.

Understanding is even more pronounced when considering flow path lengths originating from remote ends of the fuel source in FIG. 4. Assuming a centrally positioned fuel source of length $2b'$, the shortest possible path length to flue from area 40 approaches $\sqrt{a^2+b'^2}$ and a significant portion of that path length is within the subignition temperature range. In contrast the corresponding path length 48' of FIG. 5 is not only significantly longer but takes place at ignition temperatures.

The firebox 10 herein illustrated achieves virtually complete combustion with a normally seasoned fuel source as evidenced by smoke free burning and lack of soot and resin build-up.

The maintenance of the aforedescribed conditions depend:

(1) Stoichiometrically, on an adequate oxygen supply across the full length of the fuel source;

(2) Practically, on a combustion air supply introduced to remote ends of the firebox at such temperature as to preclude localized quenching; and (3) Commercially, on protection of the glass doors from the intense heat to which the other bounding firebox walls are exposed.

Figure 7:
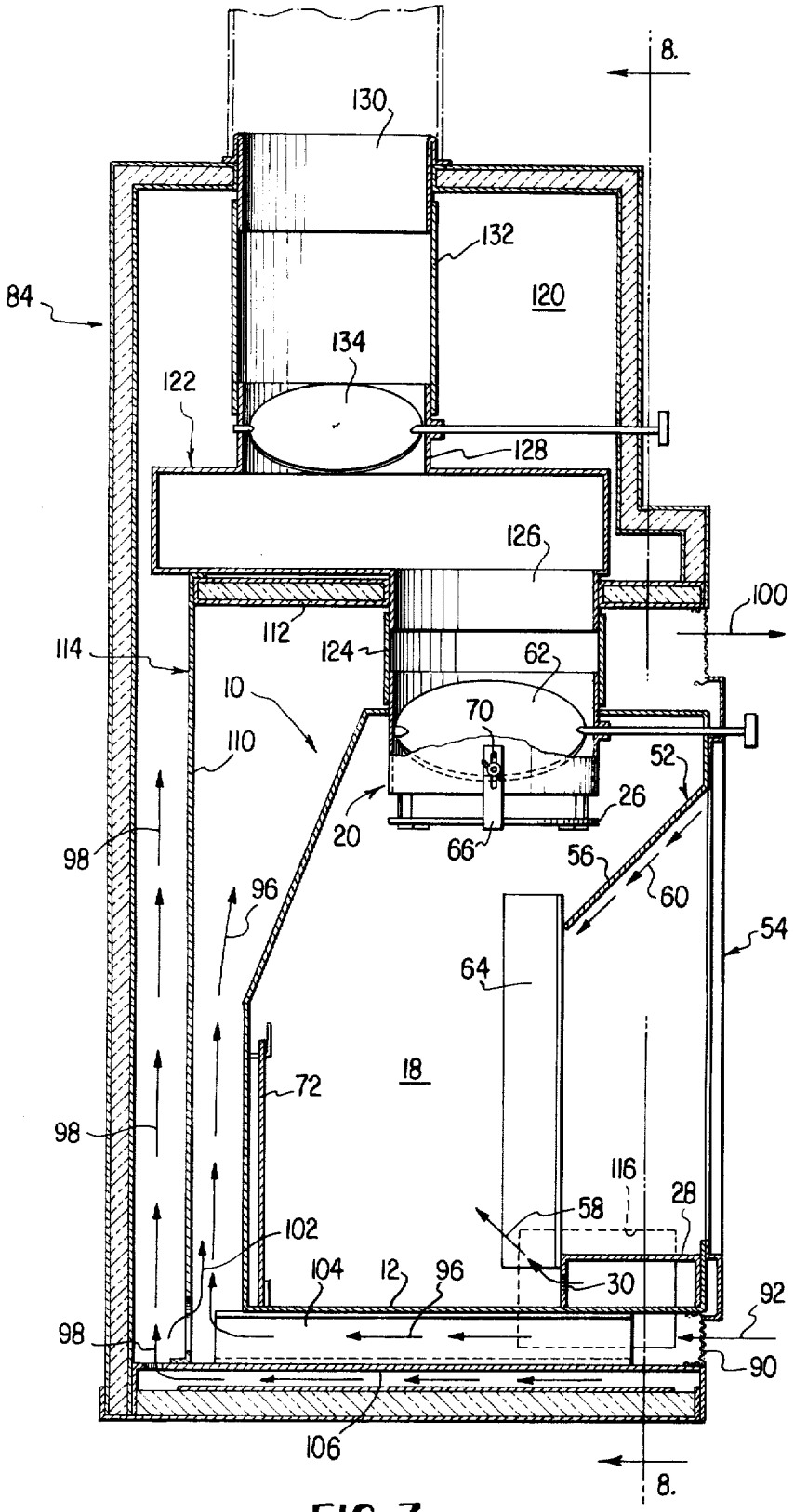
FIG. 7 is a vertical section taken along line 7—7 of FIG. 6.

Contributory to all of the above is the particular construction of preheat manifold 28 whose opposed open ends 50 bleed combustion air from convected flow as will be subsequently explained. The relatively large dimensions of manifold 28, as compared with those of inlet apertures 30, and its open ended construction assures a negligible pressure drop along the manifold length so that preheated combustion air is available across the full length of the firebox on a demand basis. Extending downwardly from upper wall 14 to a "reach" exceeding that of flue assembly 20 and inwardly to a depth approximating that of inlet apertures 30 is a front baffle 52 whose downward extent cooperates with downward flue extension 24 to maintain the entrapped air blanket and whose inward extent coacts with the particular construction of manifold 28 to shield glass doors 54 from excessive temperatures. The rearward extent of manifold 28 defines the fuel source placement or hearth area, spaced from the doors, and the natural upward component of incoming combustion air creates a partial insulating curtain adjacent the lower edge of the doors which is assisted by a natural in draft of room air which inevitably flows across the tops of the doors and is directed downwardly in shielding relation to the upper portions of the doors by the rearwardly directed extension 56 of front baffle 52. The generally directed paths of the lower and upper air curtains 58, 60, respectively, is schematically indicated in FIG. 7.

The "demand basis" availability of the preheated combustion air, i.e. excess availability infed as a function of combustion and therefore requiring no inlet grate control, is important to the overall efficiency of the system. This is so because with substantially complete combustion taking place throughout the firebox, flue damper 62 may be kept almost fully closed, making possible the minimal central draft on which the increased efficiency depends, and combustion air inducted to a function of combustion demand rather than in response to flue draft. With small central draft, the demand basis availability of combustion air allows the same to be fed across the full length of the fuel source which, taken with the preheat condition, avoids localized quenching at remote ends of the firebox. The use of preheated combustion air in the aforedescribed shielding curtain 58 minimizes temperature extremes adjacent the glass doors which is thought to be a significant factor in reducing glass breakage as explained above.

Side baffles 64 are preferably employed to divert those forwardly swirling drafts along side walls 18, which are characteristic of flash fires and down drafts, away from doors 54 and centrally of the firebox.

Baffle 26 is adjustably suspended from flue extension 24 by hanger straps 66 and wing nut fasteners 68 (only one of which is shown) coacting with slots 70 in straps 66 (FIG. 7) to take into account the usual differences in chimney draft. Thus upon installation with a strong drafting chimney, baffle 26 would be adjusted to define a minimal entry clearance 22 while with a weak drafting chimney, the clearance would be larger.

The back wall 16 of firebox 10 is conventionally protected by a replaceable plate 72.

Figure 9:
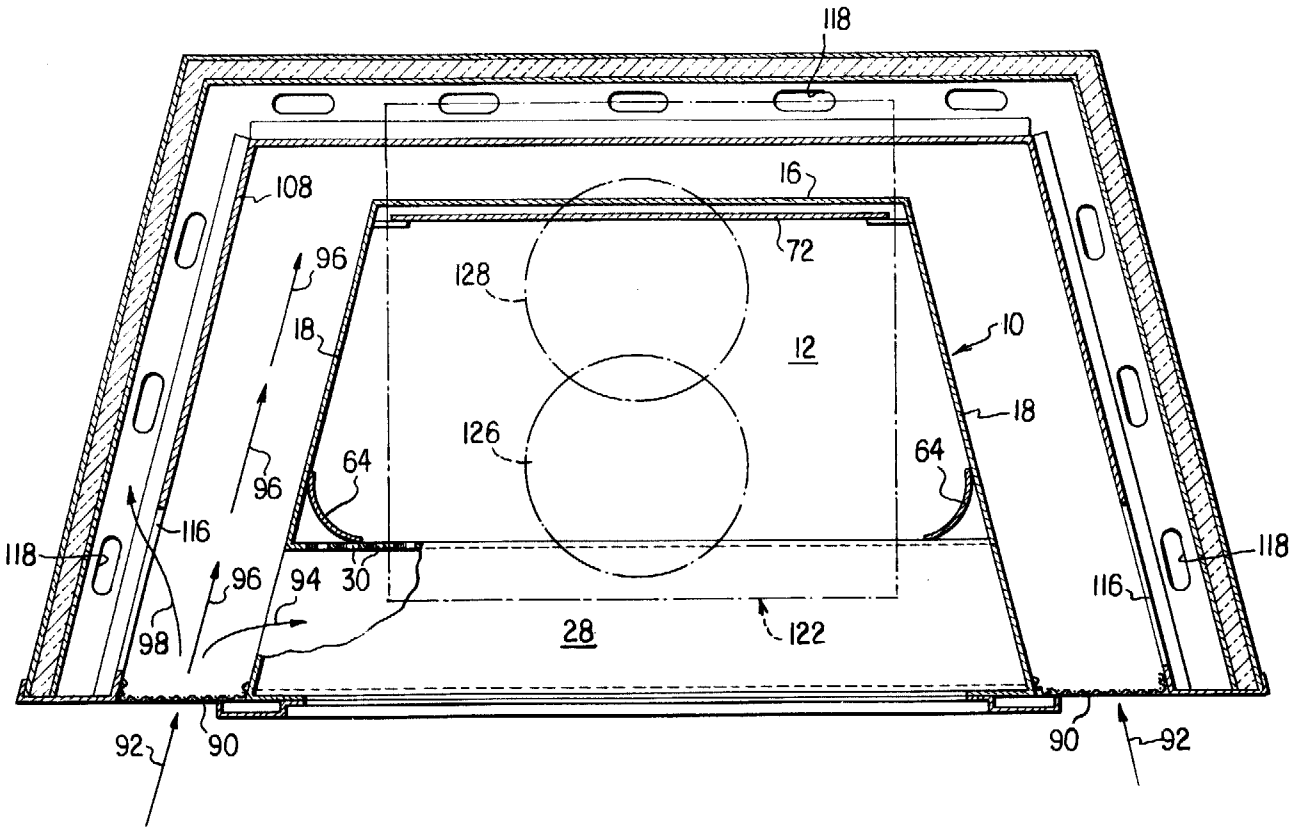
FIG. 9 is a horizontal section taken along line 9—9 of FIG. 8 overlaid by a phantom line showing of the overlying baffled flue construction.

The foregoing completes the description of firebox 10 whose role in a convective heating system employing a firebrick enclosure will be apparent from FIG. 2. Following sealing of the chimney entrance with a centrally apertured fireplace pan 74 and placement of firebox 10 on support legs 76, a flue pipe section 78 received in central opening 80 of pan 74 is fitted over flue extension 24. The generally trapezoidal shape of the firebox as viewed in horizontal section (FIG. 9) is generally similar to the corresponding enclosure walls from which the firebox is spaced and, although not shown in the drawings, the spacing of the firebox end walls 18 from the firebrick enclosure end walls is substantially the same as that illustrated in FIG. 9 showing the end wall spacing from freestanding enclosure walls.

With the firebox thus vented to chimney and sealed with respect to the space between the firebox and fireplace enclosure, the simplest form of convective heating system is defined. As the firebox walls become heated a convective flow is established in the space between the firebox and fireplace enclosure which withdraws relatively cool room air from adjacent the floor which is heated as it passes inwardly beneath bottom wall 12 and along the lower portion of side walls 18. The heated air then rises along the back wall 16 and the upper portion of the side walls 18 and is reintroduced into the room over approximately the upper half of the enclosure, i.e. from across top wall 14 and the upper portion of side walls 18. Firebox 10 is usually surrounded by a decorative grate 82 which permits free convective flow as just described. Inasmuch as the convective flow path is across substantially the full extent of each of the back, top, bottom and side walls it is obvious that exchange efficiency is a direct function of existent temperatures across the walls which explains the dramatic increase in efficiency as compared with conventional fireboxes where it is only the central portion of the back and top walls which are immediately adjacent ignition temperature ranges. As would be expected, the large heat sink defined by the firebrick enclosure, being exposed to greater temperatures over a greater area is similarly, more efficient in continuing convective exchange when the firebox begins to cool after fuel exhaustion.

A free standing, or fabricated, unit 84 incorporating the firebox 10 is illustrated in FIGS. 6–9. The exterior walls of unit 84 are of the usual sheet metal-insulation sandwich construction and the same is adapted for in-wall installation to provide a primary convective flow for room heating generally as described in connection with the firebrick enclosure of FIG. 1. Free standing unit 84 is, however, internally configured to produce a secondary convective flow, in surrounding relation to the primary flow, for the dual purposes of protecting adjacent combustible surfaces from excessive heat and effecting a secondary heat recovery which may be used to supplement the room heating effect of the primary convective flow or delivered to an adjacent room via delivery conduits 86, 88.

Figure 8:
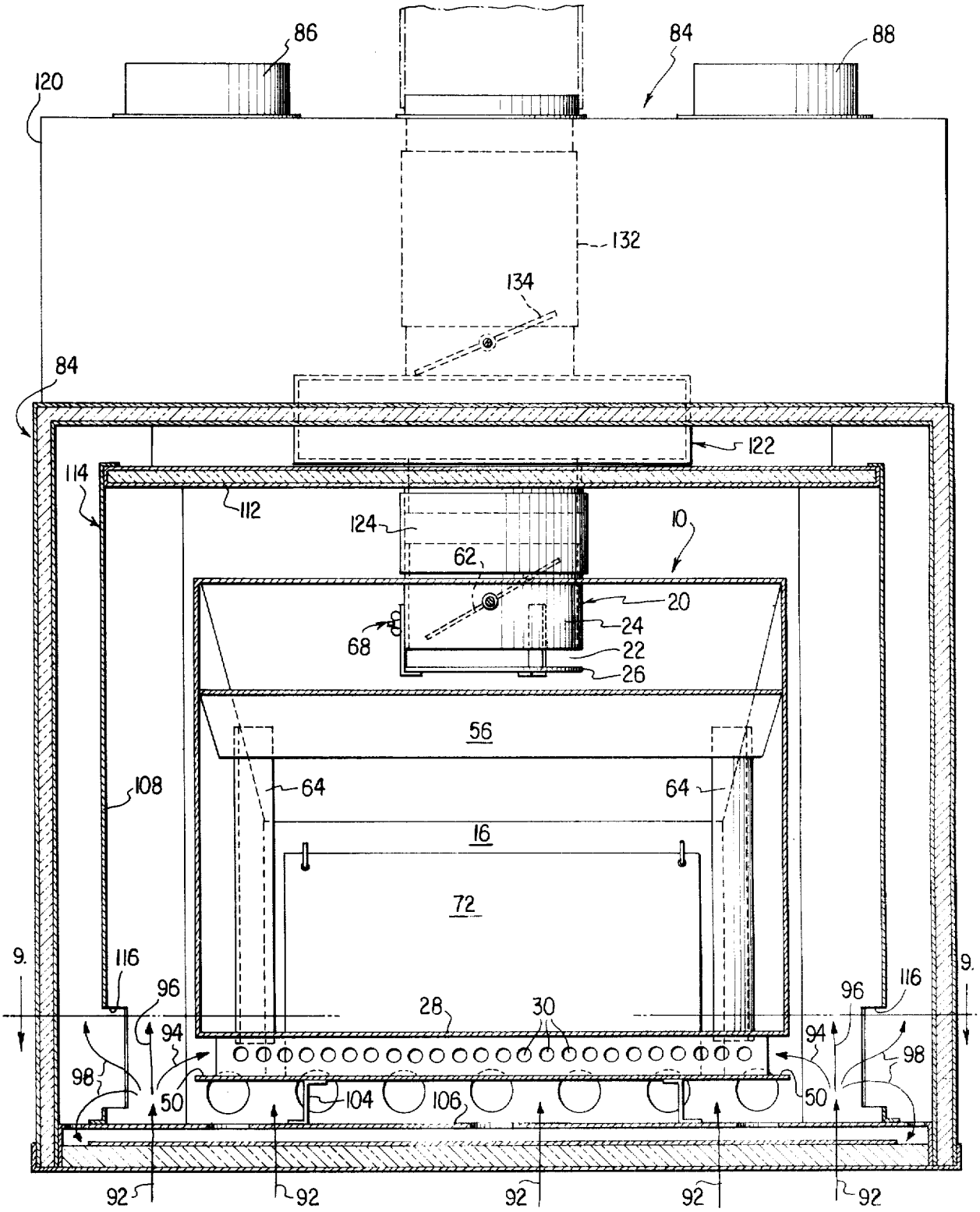
FIG. 8 is a vertical section taken along line 8—8 of FIG. 7.

In operation, the overall convected inflow of room air through decorative grating 90 is indicated by arrows 92. FIGS. 8 and 9 illustrate a typical division of convected flow 92 into combustion air 94, primary convected air flow 96 and secondary convected air flow 98. The flow of combustion air 94 into firebox 10 via preheat manifold 28 is the same as that explained in connection with the embodiment of FIG. 1. The inflow of primary convected air 96 beneath bottom wall 12 and along the lower portions of side wall 18 is similar to that previously described in that it follows the same general flow pattern for return to the room as indicated by arrows 100 (FIG. 6) but differs therefrom in that it is supplemented by a minor inflow of secondary convected air along the back wall 16 as indicated by arrow 102 (FIG. 7).

Firebox 10 is supported on elongate legs 104 above bottom wall 106 which wall 106, together with side walls 108, back wall 110 and top pan 112, define a sheet-metal fireplace enclosure 114 directing the primary convective flow path about firebox 10 generally as described with respect to the firebrick enclosure. Secondary convective flow 98 transverses the space between free standing unit 84 and fireplace enclosure 114 as best illustrated in FIGS. 7–9. An initial division of convected inflow 92 is laterally through large openings 116 in side walls 108 and downwardly through openings 118 in bottom wall 106 (see FIGS. 9 and 8, respectively) to flow rearwardly and upwardly, as indicated by arrows 98, to reach upper plenum 120 housing an upper flue trap 122 providing a significant secondary heat exchange with air flow 98 prior to its reintroduction into the room or to a related space via outlets 86 and 88.

Flue trap 122, illustrated in perspective in FIG. 3, momentarily entraps hot flue gases in a manner analogous to the deep flue assembly of firebox 10 and provides an extensive surface exchange area for the secondary convective flow. Assembly of flue trap 122 with firebox 10 is by way of connector section 124 (FIG. 7) telescopically interconnecting the outlet of deep flue assembly 20 and the inlet 126 of the flue trap. Flue trap outlet 128, interconnected with flue exhaust section 130 via intermediate connector section 132 (FIG. 7) is controlled by damper 134.

When employed with free standing enclosure 84, firebox damper 62 would normally be full open with draft control being effected by damper 134 or, in such installation, damper 62 may be omitted altogether.

I claim:

1. An improved convective heating system of the type having fireplace enclosure walls, a chimney with an apertured fireplace pan (74) for receipt of nascent products of combustion, and an elongate firebox (10) having bottom (12), top (14), back (16) and side walls (18) positioned in spaced relation to the corresponding fireplace enclosure walls and defining therewith a convective flow path of air across said firebox walls, said firebox having a front wall with a fuel receiving opening and a hearth area rearwardly of said front wall, the walls of the firebox defining an elongate volume of space within the firebox, the improvement comprising:

(A) means, connected to the firebox, for maintaining an ignition temperature range substantially throughout that elongate volume of said firebox overlying said hearth area, said means including a flue assembly (20) having a flue extension (24) passing downwardly through the top wall of the firebox into the firebox with an opening (22) for receipt of nascent combustion products, the flue extension extending below the top wall of the firebox so as to create a blanket of hot combustion products (44) adjacent the firebox top wall, the flue assembly having a flue pipe (78) connected at one end to the outlet end of the flue extension and at its other end to the apertured fireplace pan (74) of the chimney for allowing the combustion products to pass up the chimney while preventing the convective flow path of air from passing up the chimney; and (B) combustion air inlet means including a preheat manifold (28) mounted within the firebox and extending between the side walls of the firebox, the preheat manifold having at least one opening (50) at one end extending through the corresponding firebox side wall for receipt of combustion air and also having means for distributing this combustion air to the firebox hearth area.

2. The improved convective heating system of claim 1 wherein the opening at the end of the preheat manifold is positioned through the firebox side wall so as to bleed combustion air from the convected flow path of air defined between the firebox walls and the firebox enclosure walls.

3. The improved convective heating system of claim 1 including glass doors (54) for closing said fuel receiving opening; an elongate baffle (52) positioned in the firebox rearwardly of said doors and extending across the top of said fuel receiving opening; said elongate baffle extending downwardly to at least the level of the flue opening (22) for cooperating therewith to entrap the nascent combustion products above the flue opening in the air blanket (44).

4. The improved convective heating system of claim 3 wherein the preheat manifold has a rear wall and a top wall, the rear wall extending along the bottom wall of the firebox, the manifold separating the front wall of the firebox from the hearth area; and wherein the manifold means for distributing combustion air to the interior of the firebox hearth area comprises a plurality of inlet apertures spaced along the rear wall of said manifold, opening toward said hearth area; and wherein the lower distal portion of the elongate baffle extends rearwardly to overlie said preheat manifold.

5. The improved convective heating system of claim 4 wherein the means for maintaining an ignition temperature range throughout the firebox includes a baffle (26) positioned below the flue extension opening (22) for preventing direct entry of combustion products into the flue extension opening from burning fuel.

6. The improved convective heating system of claim 5 wherein the baffle is in the shape of a disc lying below the flue extension opening so that hot combustion products flow radially toward the flue assembly; and wherein the convective heating system further includes adjustable means depending from the flue extension and supporting the disc shaped baffle so as to adjust the distance between this baffle and the flue extension opening and thereby regulate the amount of combustion products that can flow into the flue extension opening.

7. The improved convective heating system of claim 4, further comprising a freestanding unit (84) and a fireplace enclosure (114) for receipt of the firebox (10), the fireplace enclosure having means for being spaced from the freestanding unit and thereby establishing a secondary convective flow path of air exteriorly of, and in heat exchange relation with, said first named convective flow path of air.

8. The improved convective heating system of claim 7 including an exterior exhaust flue (130) connected to the chimney and flue means extending between the flue assembly in said firebox and the exterior exhaust flue (130); and said flue means traversing in heat exchange relationship said secondary convective flow path of air.

9. The improved convective heating system of claim 8 wherein the portion of said flue means traversing said secondary flow path of air includes a flue trap; said flue trap comprising an offset inlet (126) connected to the flue assembly (20) for receipt of combustion products, an outlet 128 connected to the exhaust flue (130) for removal of combustion products, and a heat exchange member connected between the inlet and outlet and having a large surface area in comparison to an equal length of the remainder of said flue means.

10. An improved elongate firebox of the type having a central flue opening, a bottom, top, back and side walls, a frontal fuel receiving opening, and an elongate fuel support area of length "2 b" that exceeds the height "a" from said fuel support area to the top wall of said firebox as measured along the axis of said flue opening, the improvement comprising:

(A) means, connected to the firebox for increasing the path length to the flue opening that products of combustion emanating from fuel located at ends of the fuel support area must travel from a value approaching $\sqrt{a^2+b^2}$ to a value approaching $a+b$; said means including a flue assembly having an annular entry opening spaced below said top wall for momentarily entrapping rising products of combustion above the level of the annular entry opening;

(B) glass doors forming the fuel receiving opening in the firebox;

(C) a preheat manifold extending along the bottom wall of said firebox between the front wall thereof and the fuel support area and including a plurality of combustion air inlet apertures extending to and between remote ends of the firebox and at least one opening at one end of the manifold extending through the corresponding firebox side wall for receipt of combustion air;

(D) an elongate baffle positioned rearwardly with respect to the fuel receiving opening and extending downwardly below the length of the annular entry opening and rearwardly to overlie said preheat manifold; and (E) common means in said central flue opening for selectively controlling central draft and combustion air admission.

11. An improved elongate firebox as defined in claim 10 wherein the means for increasing the path lengths to the flue opening that products of combustion must travel further comprises a second baffle positioned below the annular entry opening of the flue assembly for preventing direct entry of combustion products into the entry opening from the burning fuel.

12. An improved elongate firebox as defined in claim 11 wherein the baffle is in the shape of a disc having a diameter approximately equal to that of the annular entry opening and wherein the firebox further comprises adjustable means depending from the flue assembly and supporting the second baffle so as to allow adjustment of the distance between the second baffle and the entry opening and thereby regulate the amount of combustion products that can flow into the entry opening.

13. An improved firebox as defined in claim 12 wherein the annular entry opening of the flue assembly is spaced below the top wall of the firebox approximately 12% of the height from the top wall to the bottom wall of the firebox and the baffle is spaced below the opening of the flue assembly between approximately 50% and 100% the distance that the opening is spaced below the firebox top wall.

14. An improved convective heating unit as defined in claims 1, 2, 3, 6, 9, or 10 wherein the flue extension depends below the top wall of the firebox approximately 12% of the height from the top wall to the bottom wall of the firebox.

15. An improved elongate firebox of the type having a central flue opening, a bottom, top, back and side walls, a frontal fuel receiving opening, and an elongate fuel support area whose length "2 b" exceeds the height "a" from said fuel support area to the top wall of said firebox, the improvement comprising means, connected to the firebox for increasing the path length to the flue opening that products of combustion emanating from a discrete portion of said fuel support area horizontally spaced a distance "X", from the axis of said flue opening must travel, from a value approaching $\sqrt{a^2+x^2}$, to a value approaching; $a+x$, said means including a flue assembly having an annular entry opening spaced below said top wall, a disc shaped baffle having a diameter approximately equal to the diameter of the annular entry opening, the baffle spaced below the entry opening so as to allow the products of combustion to enter the entry opening throughout approximately 360 degrees, and means, connected to the flue assembly and the baffle, for adjustably positioning the baffle below the entry opening, where the distance "x" is equal to or less than "b".

16. An improved firebox as defined in claim 15 further comprising a preheat manifold extending along the bottom wall of the firebox between the side walls of the firebox and having open ends extending through the side walls of the firebox for receipt of combustion air, the manifold having a rear wall and a top wall defining a channel with the bottom wall of the firebox, the rear wall of the manifold including a plurality of combustion air inlet apertures extending across the entire length of the manifold for delivery of combustion air to fuel placed within the firebox for combustion.

17. An improved firebox as defined in claim 16, further comprising an elongated baffle positioned between the side walls of the firebox and extending rearwardly and downwardly from the front top of the firebox fuel access opening so as to substantially overlie the preheat manifold.

18. A free-standing convective heating unit for use with a chimney, comprising:

(A) a free-standing unit (84) having bottom, back, side, and top insulative walls for defining a frontally open space, the top wall having an aperture communicable with a chimney for the escape of combustion products and at least one delivery conduit (86 or 88) for providing secondary convective air flow to a room;

(B) a fireplace enclosure (114) mounted within the frontally open space of the free-standing unit, having a bottom wall (106) spaced above the bottom wall of the free-standing unit so as to provide for secondary convective air flow therebetween, side walls (108), a back wall (110), and a top pan (112) having an aperture for passing products of combustion therethrough, the bottom wall, side walls, back wall and top pan defining a frontally open enclosure, and the back wall of the fireplace enclosure spaced away from the back wall of the free-standing unit so as to provide for a space between these walls for the secondary convective air flow, this space having access of air through portions of the fireplace enclosure and also communicating with the delivery conduit in the free-standing unit for removal of this secondary convective air flow to a room; and (C) a firebox (10) mountable within the fireplace enclosure, having a bottom wall (12), top wall (14), back wall (16) and side walls (18) and pivotal glass doors at its front for defining a fuel access opening to the interior of the firebox, the firebox having legs (104) depending from the bottom wall of the firebox for spacing the bottom wall of the firebox above the bottom wall of the fireplace enclosure so as to define therebetween a space for the in-flow of primary convective air (96), the back wall of the firebox spaced from the back wall of the fireplace enclosure so as to define a space therebetween for the passage of primary convective air flow, and the top wall of the firebox spaced beneath the top pan of the fireplace enclosure so as to define a space therebetween for the exiting of the primary convective air flow (100) into a room, the firebox having a flue assembly passing through the top wall of the firebox to communicate with the aperture in the top wall of the free-standing unit for the escape of combustion products from the firebox, the firebox further having means communicating with the primary convective air flow for bleeding combustion air from this primary convective air flow into the interior of the firebox for combustion purposes;

whereby the secondary convective air flow is in surrounding relationship with the primary convective air flow for the dual purpose of maintaining the walls of the free-standing unit at a relatively low temperature so that the unit may be enclosed within a room, and for purpose of obtaining secondary heat recovery between the fireplace enclosure walls and the free-standing unit for delivering this secondary convective air flow into a room for heating purposes, and wherein the primary convective air flow is delivered to the room for heating purposes with the combustion air obtained from the primary convective air flow and with the secondary convective air also obtained from the primary convective air flow.

19. The free-standing unit of claim 18 wherein the firebox means for communicating with the primary convective air flow comprises a preheat manifold on the bottom wall of said firebox extending across the full length of said fuel access opening, the manifold having a rear wall with a plurality of combustion air inlet apertures opening therefrom and extending along the full length thereof, the preheat manifold having opposed open ends extending through the corresponding firebox side walls for bleeding combustion air from the primary convective air flow.

20. The free-standing unit of claim 19 wherein portions of the fireplace enclosure that provide access of air for the secondary convective air flow comprise portal openings in the bottom, back and side walls of said fireplace enclosure.

21. The free standing unit of claim 20 including secondary heat exchange means in said secondary convective air flow, comprising:

(1) flue extension means extending upwardly from said firebox, through the top pan of said fireplace enclosure and into an upper plenum defined between the top pan of said fireplace enclosure and the top wall of the free-standing unit; and (2) a flue trap in said upper plenum comprising an offset inlet connected to the flue assembly for the receipt of combustion products, an outlet connected to the aperture in the top wall of the free-standing unit, and a heat exchange member connected between the inlet and outlet, and having a cross section and aggregate surface area which is large in comparison with the inlet and outlet cross-sectional areas, whereby hot flue gases are momentarily entrapped for secondary heat exchange with said secondary convective air flow.

22. the free-standing unit of claim 21 including a flue damper in the outlet of the flue trap; and the flue path from said firebox to said flue damper in the outlet of the flue trap being substantially fully open whereby combustion and firebox draft are controlled by the flue trap damper.

23. The free standing unit of claim 19 including a central flue in said firebox having an entry opening spaced below the top wall of said firebox and a baffle spaced below the entry opening for momentarily entrapping the hottest rising products of combustion thereabove before exiting into the entry opening.

24. A free-standing convective heating unit as defined in claim 18 or 19, wherein the flue assembly of the firebox has a flue extension passing through the top wall of the firebox with an opening for receipt of combustion products, the flue extension extending below the top wall of the firebox so as to create a blanket of hot combustion products adjacent the firebox top wall so as to maintain an ignition temperature range substantially throughout the entire volume of the firebox.

25. A free-standing convective heating unit as defined in claim 24, further comprising an elongated baffle positioned between the side walls of the firebox and extending rearwardly and downwardly from the front top of the firebox fuel access opening so as to substantially overlie the preheat manifold.

26. A method of effecting substantially complete combustion within an elongate firebox having bottom, top, back, and side walls, and having a central flue opening therein, an elongate fuel support area having a length "2b" that exceeds the height "a" from the fuel support area to the top wall of the firebox, comprising the steps of:

(A) increasing the path length to the flue that products of combustion emanating from fuel located at ends of the fuel support area must travel from a value approaching $\sqrt{a^2+b^2}$ to a value approaching $a+b$; by establishing a flow path of said products of combustion first upwardly above the level of said flue opening, then laterally toward said flue opening and then downwardly to exit said flue opening; and (B) establishing a stoichiometric oxygen supply across the fuel support area.

27. The method of claim 26 including the step of preheating said oxygen supply.

28. The method of claim 27 including the step of establishing a primary convective air flow across the bottom, top, back and side walls of said firebox.

29. The method of claim 28 including the step of bleeding said oxygen supply from said primary convective air flow.

* * * * *